US011064745B1

(12) United States Patent
Ahmed

(10) Patent No.: US 11,064,745 B1
(45) Date of Patent: Jul. 20, 2021

(54) FACE MASK WITH SEPARATE INHALING AND EXHALING PORTIONS

(71) Applicant: UNITED ARAB EMIRATES UNIVERSITY, Al Ain (AE)

(72) Inventor: Waleed Khalil Ahmed, Al Ain (AE)

(73) Assignee: UNITED ARAB EMIRATES UNIVERSITY, Al Ain (AE)

( * ) Notice: Subject to any disclaimer, the term of this patent is extended or adjusted under 35 U.S.C. 154(b) by 0 days.

(21) Appl. No.: 17/096,843

(22) Filed: Nov. 12, 2020

(51) Int. Cl.
*A41D 13/11* (2006.01)
*A42B 3/22* (2006.01)
*A41D 31/12* (2019.01)

(52) U.S. Cl.
CPC ..... *A41D 13/1123* (2013.01); *A41D 13/1161* (2013.01); *A41D 13/11* (2013.01); *A41D 13/1176* (2013.01); *A41D 31/125* (2019.02); *A42B 3/22* (2013.01); *A42B 3/225* (2013.01)

(58) Field of Classification Search
CPC ..... A41D 13/1192; A41D 13/11; A41D 13/1176; A41D 13/1161; A41D 13/1123; A41D 31/125; A42B 3/22; A42B 3/225
USPC ..... 2/9
See application file for complete search history.

(56) References Cited

U.S. PATENT DOCUMENTS 1,562,302 A * 11/1925 Mansfield ..... A41D 13/1192 128/206.13
1,987,922 A * 1/1935 Blatt ..... A41D 13/1123 128/863
2,634,724 A * 4/1953 Burns ..... A41D 13/1123 128/206.19
4,248,220 A * 2/1981 White ..... A41D 13/1123 128/206.16
4,300,549 A * 11/1981 Parker ..... A41D 13/1115 128/206.19
4,419,993 A * 12/1983 Petersen ..... A41D 13/1123 128/201.15
5,127,397 A * 7/1992 Kohnke ..... A61M 16/0048 128/202.28
5,561,863 A * 10/1996 Carlson, II ..... A41D 13/1115 128/206.19

(Continued)

FOREIGN PATENT DOCUMENTS

CN 105246553 A 1/2016
CN 106562493 A 4/2017

(Continued)

OTHER PUBLICATIONS

"Labato Mask Extender Hooks," (C) 1996-2020, Amazon.com, Inc.

*Primary Examiner* — Khaled Annis
*Assistant Examiner* — Dakota Marin
(74) *Attorney, Agent, or Firm* — Nath, Goldberg & Meyer; Richard C. Litman

(57) ABSTRACT

A face mask with separate inhaling and exhaling portions can include an upper mask portion and a lower mask portion. A plurality of folds extend across each of the upper and lower mask portions. The lower mask portion can be larger than the upper mask portion. A lower edge of the upper mask portion can be secured to an upper edge of the lower portion. In use, the upper mask portion can cover the nose and the lower mask portion can cover the mouth. A user can inhale through the upper portion and exhale through the lower portion. In this manner, $CO_2$ exhaled by the user will not mix with air that is inhaled.

8 Claims, 8 Drawing Sheets

(56) References Cited

U.S. PATENT DOCUMENTS 5,740,798 A * 4/1998 McKinney ..... A41D 13/1161 128/206.14
5,934,275 A * 8/1999 Gazzara ..... A41D 13/1115 128/205.27
5,954,055 A * 9/1999 Miyake ..... A41D 13/1115 128/206.12
6,062,220 A * 5/2000 Whitaker ..... A41D 13/11 128/206.12
6,427,693 B1 * 8/2002 Blackstock ..... A41D 13/11 128/205.27
6,474,336 B1 * 11/2002 Wolfe ..... A41D 13/1115 128/206.12
6,718,981 B2 * 4/2004 Cardarelli ..... A61F 9/045 128/205.27
6,945,249 B2 * 9/2005 Griesbach, III ... A41D 13/1146 128/206.12
7,152,601 B2 * 12/2006 Barakat ..... A41D 13/1115 128/206.14
7,210,482 B2 * 5/2007 Huang ..... A41D 13/1115 128/205.25
7,725,948 B2 * 6/2010 Steindorf ..... A41D 13/1115 2/9
9,629,401 B2 * 4/2017 Al Malki ..... A41D 13/1192
9,826,786 B2 * 11/2017 Duffy ..... A41D 13/1115
10,486,001 B1 * 11/2019 Bailey ..... A41D 13/1115
2003/0047186 A1 * 3/2003 Dyer ..... A61M 15/00 128/203.29
2004/0163649 A1 * 8/2004 Shao ..... A41D 13/1192 128/205.27
2007/0023047 A1 * 2/2007 Zalsman ..... A62B 23/025 128/206.19
2007/0068529 A1 3/2007 Kalatoor et al.
2009/0126064 A1 * 5/2009 Reaux ..... A41D 13/1161 2/15
2009/0255542 A1 * 10/2009 Ugai ..... A62B 23/025 128/863
2010/0239625 A1 * 9/2010 Puckett ..... A41D 13/1192 424/402
2011/0180078 A1 * 7/2011 McKinley ..... A41D 13/1161 128/863
2012/0060258 A1 * 3/2012 Stewart ..... A01N 59/16 2/206
2014/0034059 A1 * 2/2014 Yagi ..... A61M 16/06 128/207.11
2016/0015098 A1 * 1/2016 Conlon ..... A41D 13/1192 128/863
2017/0367416 A1 * 12/2017 Yamada ..... B01J 20/06
2018/0295907 A1 * 10/2018 Ahoubim ..... A41D 13/1115
2020/0163392 A1 * 5/2020 Sakurai ..... A41D 13/1161
2020/0215363 A1 * 7/2020 Sakurai ..... A41D 13/1161

FOREIGN PATENT DOCUMENTS

KR 10-0660605 B1 12/2006
TW 200932301 A 8/2009
WO 2019199103 A1 10/2019

* cited by examiner

FACE MASK WITH SEPARATE INHALING AND EXHALING PORTIONS

BACKGROUND

1. Field

The disclosure of the present patent application relates to face masks, and particularly to a face mask with separate inhaling and exhaling portions.

2. Description of the Related Art

Certain infectious diseases, such as COVID-19, which is caused by severe acute respiratory syndrome coronavirus 2 (SARS-CoV-2), are readily spread through exhaled droplets and aerosols. Although social distancing has proven effective at mitigating the spread of such diseases, social distancing can be difficult to implement in the workplace, schools, and other public areas.

Many health agencies have recommended wearing face masks in public to prevent spread of viruses. For many, e.g., those suffering from a chronic respiratory condition such as asthma or COPD, it can be difficult to comply with these recommendations. Many find that the physical barrier of the mask makes it harder to take in air and are concerned that the mask traps some carbon dioxide that is exhaled, which forces the user to then inhale the carbon dioxide. Thus, it is believed that many conventional masks can cause carbon dioxide inhalation. Hypercapnia (carbon dioxide toxicity) can cause headache, vertigo, double vision, inability to concentrate, tinnitus, seizures, or suffocation due to displacement of air.

Thus, a face mask solving the aforementioned problems is desired.

SUMMARY

A face mask with separate inhaling and exhaling portions can include an upper mask portion and a lower mask portion. A plurality of folds extends across each of the upper and lower mask portions. Exterior folds of the upper mask portion can be directed in a first direction. Exterior folds of the lower mask can be directed in a second direction, opposing the first direction. In an embodiment, the upper mask portion includes interior folds oriented in the same direction as the exterior folds of the upper mask portion. In an embodiment, the lower mask portions includes interior folds oriented in the same direction as the exterior folds of the lower mask portion. The lower mask portion can be larger than the upper mask portion. A lower edge of the upper mask portion can be secured to an upper edge of the lower mask portion. In use, the upper mask portion can cover the nose of the wearer and the lower mask portion can cover the mouth of the wearer. A user can inhale through the upper mask portion and exhale through the lower mask portion to, thereby, avoid inhaling $CO_2$ exhaled by the user.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

A face mask 10 with separate inhaling and exhaling portions can include an upper mask portion 12, a lower mask portion 14, and elastic loops 11*a*, 11*b* attached to respective side edges of the face mask 10. The face mask 10 is configured to cover a wearer's nose, mouth, chin, and at least a portion of the wearer's cheeks to protect the wearer from airborne microbes in the environment and/or minimize a risk of spreading airborne microbes from the user. The upper mask portion 12 is configured to cover the wearer's nose, and not the wearer's mouth. The lower mask portion 14 is configured to cover the wearer's mouth, and not the wearer's nose. The lower mask portion 14 can be wider than the upper mask portion. A user can inhale through the upper mask portion 12 and exhale through the lower mask portion 14 to, thereby, avoid inhaling $CO_2$ exhaled by the user.

Figure 3A:
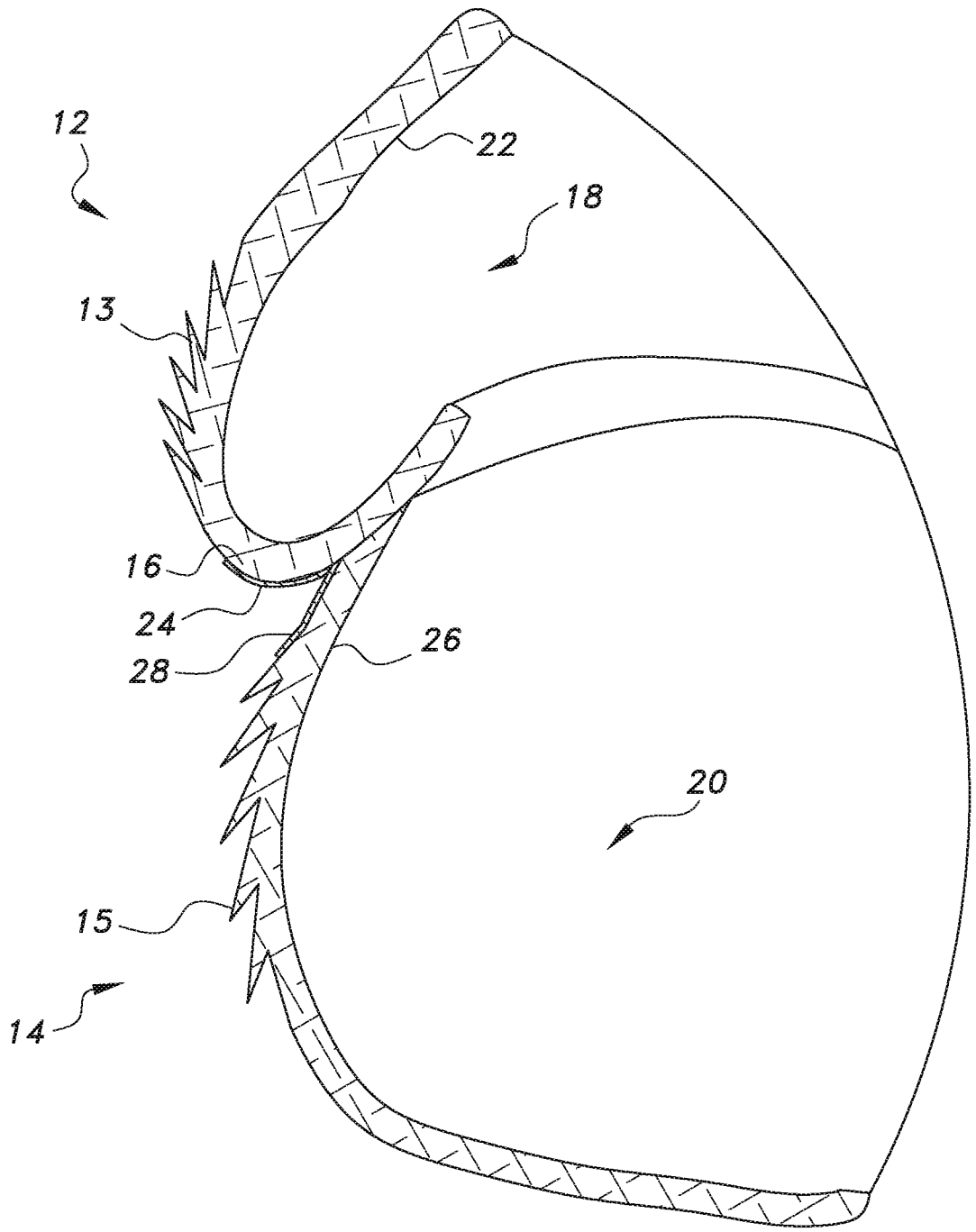
FIG. 3A is an exploded view of the upper and lower mask portions of an embodiment of the face mask according to the present teachings.
Figure 3B:
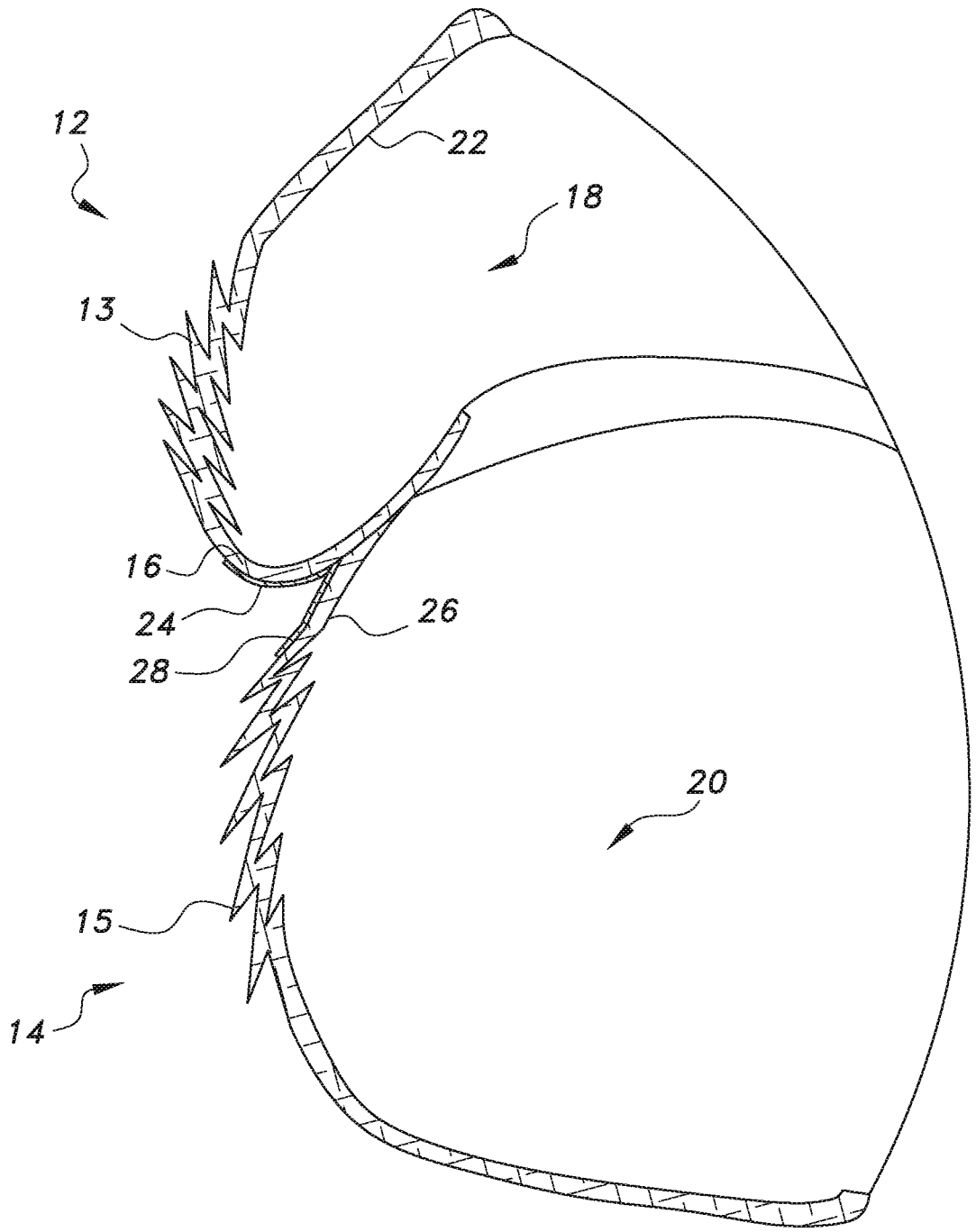
FIG. 3B is an exploded view of the upper and lower mask portions of an alternative embodiment of the face mask according to the present teachings.

Each of the upper and lower mask portions 12, 14 can be formed from one or more layers and can include a plurality of folds. In an embodiment, the upper mask portion 12 can include upper directional folds 13 that are formed by folding the exterior surface of the upper mask portion 12 upwards or in a first direction (FIG. 3A). In an embodiment, the upper directional folds 13 are formed by folding both the exterior and interior surface of the upper mask portion 12 upwards or in a first direction (FIG. 3B). The upper directional folds 13 facilitate air to enter the upper mask portion 12 from an upward direction, away from the lower mask portion 14. The lower mask portion 14 can be larger or wider than the upper mask portion 12. In an embodiment, the lower mask portion 14 includes lower directional folds 15 that are formed by folding the exterior surface of the lower mask portion 14 downwards or in a second direction, opposite the first direction (3A). In an embodiment, the lower directional folds 15 are formed by folding the exterior and interior surfaces of the lower mask portion 14 downwards or in a second direction, opposite the first direction (FIG. 3B). The downward direction of the folds facilitates exhaled air to be directed in a downward direction, away from the upper mask portion 12. A lower end portion of the upper mask portion 12 includes a curved portion 16 that extends below the lower edge of the upper mask portion 12. The lower edge of the upper mask portion 12 can be secured to an upper edge of the lower mask portion 14. This configuration allows a user to inhale air through the upper mask portion 12 and exhale $CO_2$ through the lower mask portion 14 while minimizing the risk of inhaling $CO_2$ exhaled by the user.

The upper mask portion 12 and the lower mask portion 14 can be made as separate components and then subsequently connected together. The upper and lower mask portions 12, 14 can be attached by sewing, ultrasonic welding, or by chemicals, such as glues or adhesives. In an alternative, the upper and lower mask portions 12, 14 can be removably connected by mechanical fasteners (e.g., hook and loop fasteners (e.g., VELCRO fasteners, or any other suitable detachable fastener). In the alternative, the upper and lower mask portions 12, 14 may be unitarily formed as a single piece construction.

The folds 13, 15 in the upper and lower mask portions 12, 14 can be formed by stitches 17 that join together lateral folds along opposing sides of the upper and lower mask portions 12, 14. Although stitches are described, it should be understood that the folds can be joined together by any suitable means. The resulting folds in the upper mask portion provide a three-dimensional shape to allow the user to have coverage from the bridge of the user's nose to under the nose and above the mouth. The folds 13 encapsulate the nose area in an accordion-like effect. The accordion-like effect in the material defines a first space 18 that is between the interior surface of the upper mask portion and at least the user's nose when the upper mask portion is properly worn. The resulting folds in the lower mask portion provide a three-dimensional shape to allow the user to have coverage of the mouth, but not the nose. The folds 15 encapsulate the mouth area in an accordion-like effect. The accordion-like effect in the material defines a second space 20 that is between the interior surface of the lower mask portion and the mouth when the lower mask portion is properly worn At least a portion of the upper mask portion 12 can be made of the same material as at least a portion of the lower mask portion 14. Alternatively, at least a portion of the upper mask portion 12 can be made of a material different from that of at least a portion of the lower mask portion 14. The upper and lower mask portions 12, 14 can have the same or different colors. In an embodiment, the lower mask portion 14 can be made from a transparent material to facilitate the hearing impaired.

The upper and lower mask portions 12, 14 can be formed of one or more layers of a breathable fabric material or paper material commonly used in the art for protective masks. In an embodiment, the material can be antimicrobial.

As shown in FIGS. 3A-3B, the upper mask portion 12 can include an inner material layer 22 and an outer insulating layer 24. The outer insulating layer 24 can be formed along a lower portion of the inner material layer 22 of the upper mask portion 12. The outer insulating layer 24 can be formed by, for example, spraying a suitable insulating substance on the inner material layer 22. The upwardly oriented folds 13 of the upper mask portion 12 can allow air to flow into the first space 18 from an upward direction and minimize the chance of exhaled air from the second space 20 to flow into the first space 18, with the outer insulating layer deflecting and diffusing air coming out of the lower mask portion 14. Similarly, the lower mask portion 14 can include an inner material layer 26 and an outer insulating layer 28, similar to the upper mask portion 12. The outer insulating layer 28 of the lower mask portion 14 can be formed along an upper portion of the inner material layer of the lower mask portion 14. The downwardly oriented folds 15 of the lower mask portion 14 and the outer insulating layer 28 can minimize upward flow of $CO_2$ exhaled by the user.

Figure 1:
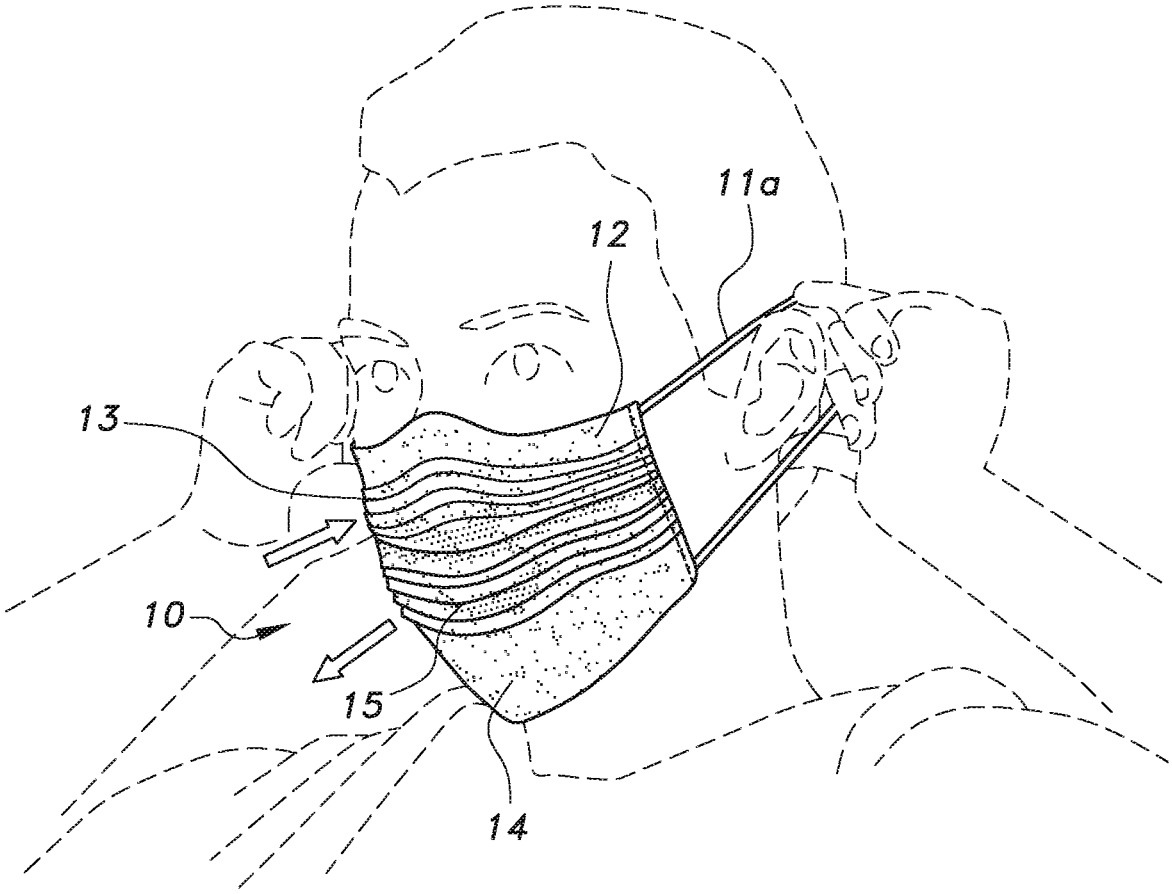
FIG. 1 is an environmental, perspective view of a face mask according to the present teachings.
Figure 2:
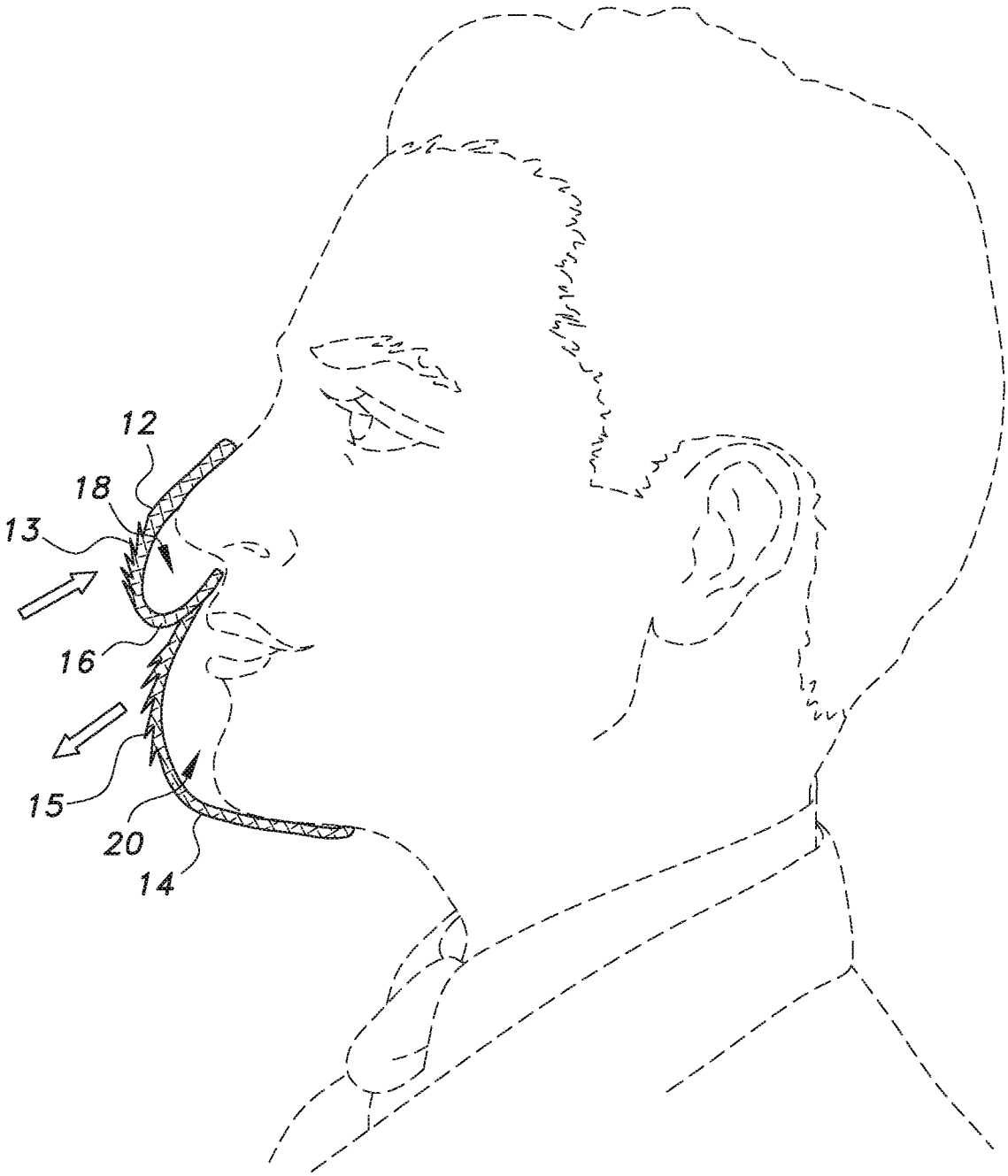
FIG. 2 is a cross-sectional side view of the mask according to the present teachings.
Figure 4A:
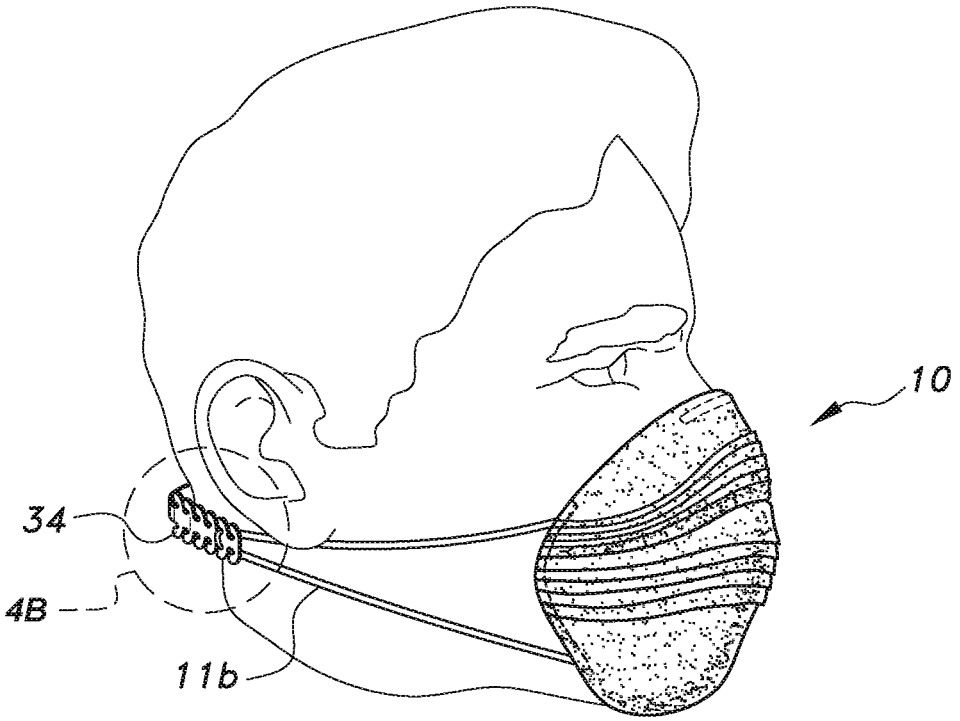
FIG. 4A is an environmental, perspective view of a face mask connected to a face mask extender according to the present teachings.
Figure 4B:
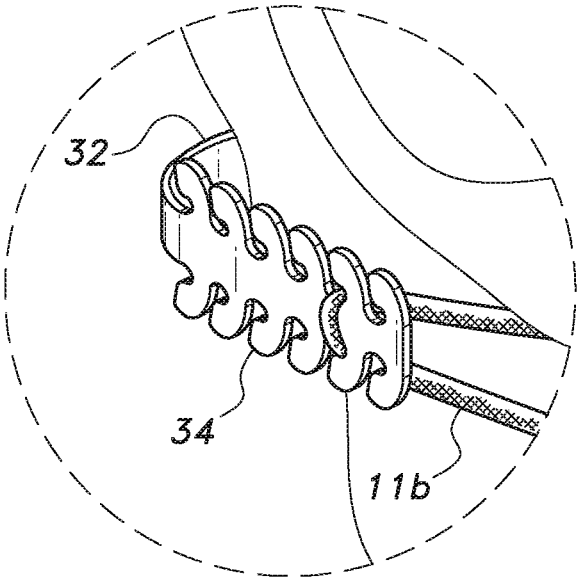
FIG. 4B is an enlarged view of the face mask extender shown in FIG. 4A.
Figure 5:
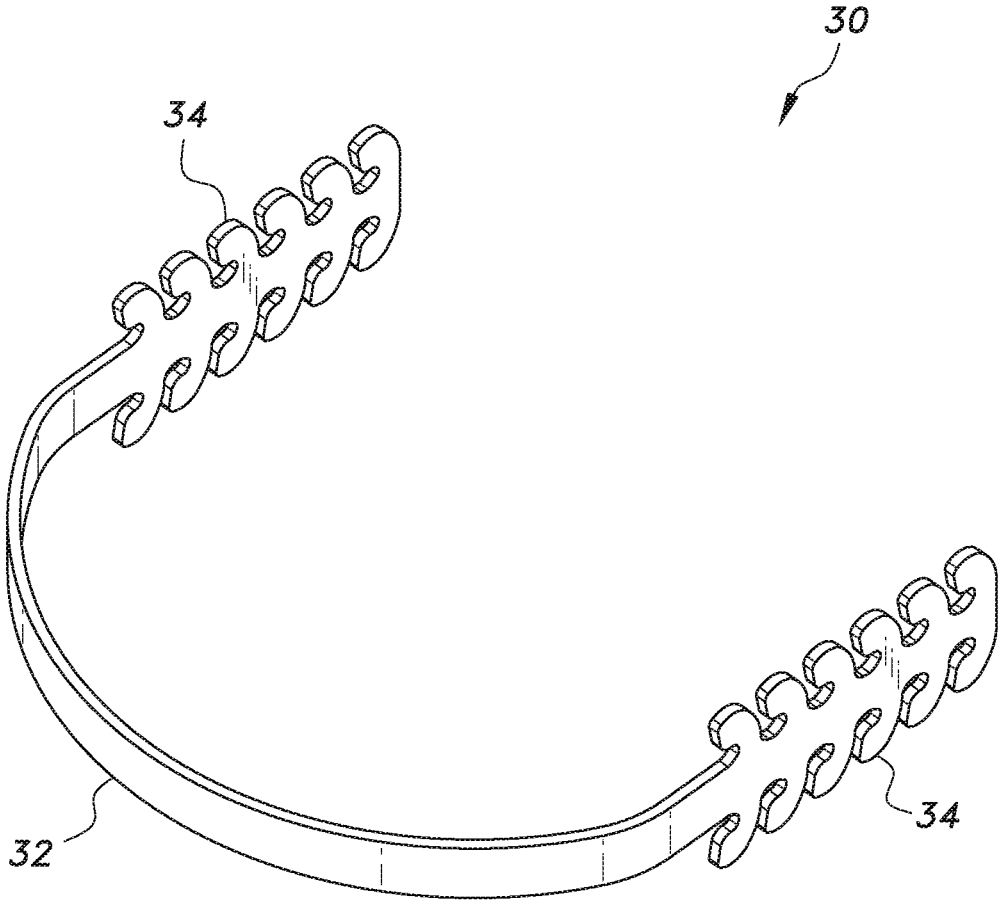
FIG. 5 is a perspective view of one embodiment of the face mask extender.
Figure 6:
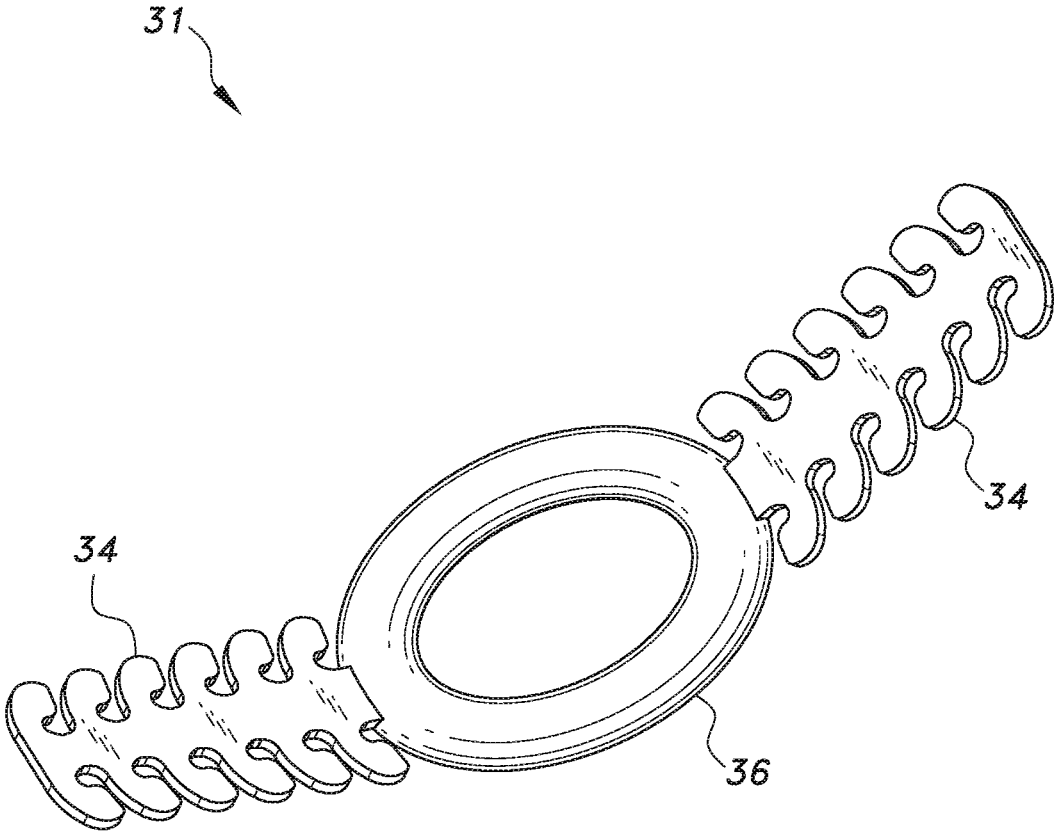
FIG. 6 is a perspective view of an alternative embodiment of the face mask extender.
Figure 7:
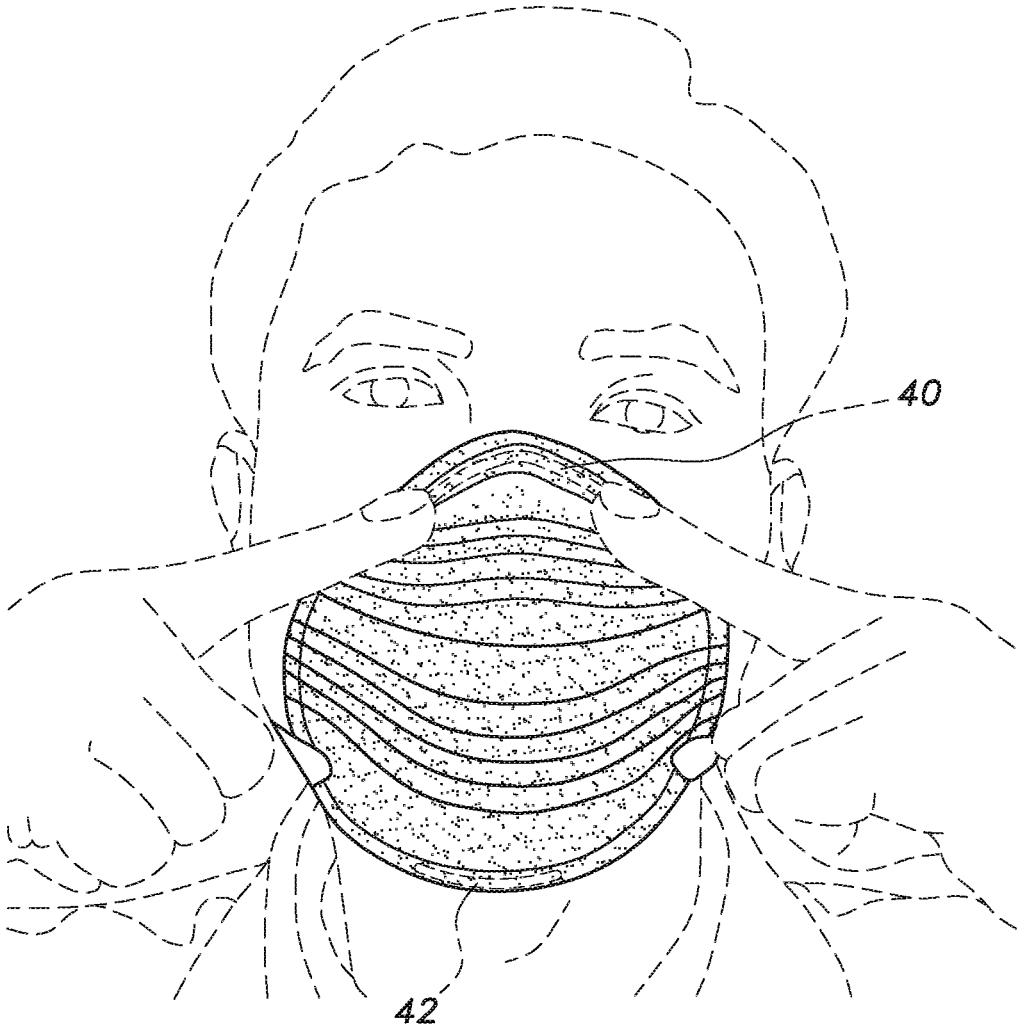
FIG. 7 is an environmental, front view of an embodiment of the face mask according to the present teachings.

The elastic loops 11*a*, 11*b* can be attached directly to a user's ears, as shown in FIG. 1. Alternatively, the elastic loops 11*a*, 11*b* can be attached to a flexible face mask extender 30 positioned behind the user's neck, shown in FIGS. 4A-5. The flexible face mask extender 30 is defined by a thin band 32 having a plurality of hooks 34 extending along opposing ends of the band. As shown in FIG. 4B, two opposing hooks 34 can support a selected one of the elastic loops 11*a*, 11*b*. The mask extender 30 can be made from any suitable flexible material, e.g., a plastic or rubber material. The elastic loops can be connected to the hooks 34 of the mask extender 30 and the mask extender can be worn around the user's neck, as shown. The thin band 32 can be formed from a polymeric or rubber material.

In an alternative embodiment, a mask extender 31 can be provided that is similar to mask extender 30, but includes a central ring 36 disposed at a center of the band 32, between the plurality of hooks 34. The central ring 36 can be configured for receiving a user's hair, e.g., a ponytail, therethrough.

The upper mask portion 12 can include a first bendable strip 40. In an embodiment, the first bendable strip 40 is disposed within a pocket formed at the upper edge of the upper mask portion 12. The first bendable strip 40 can be formed from a suitable plastic material, e.g., shape memory plastic (SMP) that retains its shape once bent and is conformable to at least a bridge portion of the user's nose. In an embodiment, the first bendable strip 40 is formed from shape memory plastic (SMP) that can be softened and shaped as desired upon application of heat, e.g., hot air from a blow dryer. The bendable strip 40 can also come in various forms including, without limitation, a thin elongated bar, a thin elongated rod, or any thin elongated circular or polygonal shape, and the like. It is preferred that the bendable strip 40 has a flat surface on the side facing the user's face in order to avoid any unnecessary pressure on the user's face. In an embodiment, the bendable strip 40 not only extends across and rests upon the upper bridge of the user's nose, but also extends and rests upon the upper cheekbones of the user, thereby disbursing the pressure of the entire mask onto a broader surface of the user's face. The bendable strip 40 disperses pressure to the user's cheekbones, eliminates any discomfort, and allows the upper mask portion 12 to be contoured to the user's unique face. In an embodiment, the lower mask portion 14 can include a second bendable strip 42 disposed within a pocket formed at the lower edge of the lower mask portion. 14 The second bendable strip 42 can be formed from the same material as the first bendable strip 40.

It is to be understood that the face mask with separate inhaling and exhaling portions is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A face mask, comprising:

an upper mask portion comprising a plurality of folds, the plurality of folds of the upper mask portion being directed in a upward direction and being formed on an exterior surface of the upper mask portion, the upper mask portion being made of a first material, the upper mask portion having a U-shaped lower edge portion configured and dimensioned to accommodate a user's nose;

a lower mask portion directly connected to the upper mask portion, the lower mask portion comprising a plurality of folds, the plurality of folds of the lower mask portion being directed in a downward direction, opposite the upward direction, whereby exhaled air does not interfere with the inhaled air of the upper mask portion, and being formed on an exterior surface of the lower mask portion, the lower mask portion being wider than the upper mask portion and having an upper edge portion directly connected to the lower edge portion of the upper mask portion, the lower mask portion being made of a second material different than the first material;

a first ear loop connected to first side edges of each of the upper and lower mask portions; and a second ear loop connected to second side edges of each of the upper and lower mask portions.

2. The face mask as recited in claim 1, wherein the plurality of folds of the upper mask portion are formed on the exterior surface and an interior surface of the upper mask portion and the plurality of folds of the lower mask portion are formed on the exterior surface and an interior surface of the lower mask portion.

3. The face mask as recited in claim 1, wherein the lower mask portion is made from a transparent material.

4. The face mask as recited in claim 1, further comprising a bendable strip disposed at the upper edge of the upper mask portion.

5. The face mask as recited in claim 1, wherein the lower edge portion of the upper mask portion is detachably connected to the upper edge portion of the lower mask portion.

6. The face mask as recited in claim 1, further comprising a bendable strip along the lower edge of the lower mask portion.

7. The face mask as recited in claim 1, further comprising a mask extender, the mask extender including a band and a plurality hooks extending from opposing side edges of the band, each loop of the face mask being selectively connected to a pair of opposing hooks.

8. The face mask as recited in claim 7, further comprising a ring defined within a central portion of the band.

* * * * *